United States Patent [19]

Ueda

[11] Patent Number: 4,854,439

[45] Date of Patent: Aug. 8, 1989

[54] DOFFED PACKAGE TRANSPORTING SYSTEM

[75] Inventor: Yutaka Ueda, Nara, Japan

[73] Assignee: Murata Kikai Kabushiki Kaisha, Kyoto, Japan

[21] Appl. No.: 894,286

[22] Filed: Aug. 7, 1986

[30] Foreign Application Priority Data

Aug. 14, 1985 [JP] Japan ..... 60-178884

[51] Int. Cl.[4] ..... B65G 47/46

[52] U.S. Cl. ..... 198/350; 242/35.5 A; 198/487.1

[58] Field of Search ..... 198/350, 358, 349, 355, 198/362, 365, 366, 370, 487.1; 242/35.5 A, 35.5 R

[56] References Cited

U.S. PATENT DOCUMENTS

| | | | |
|---|---|---|---|
| 3,168,053 | 2/1965 | Miroux | 198/350 X |
| 3,200,933 | 8/1965 | Schenk et al. | 198/350 |
| 3,328,597 | 6/1967 | DeWitt et al. | 198/350 X |
| 3,363,742 | 1/1968 | Raynor | 198/350 |
| 3,726,383 | 4/1973 | Bornfleth et al. | 198/358 X |
| 3,880,298 | 4/1975 | Habegger et al. | 198/349 X |
| 3,889,797 | 6/1975 | Naito et al. | 198/350 X |
| 4,576,341 | 3/1986 | Matsui et al. | 242/35.5 A |

OTHER PUBLICATIONS

"REA's Sorter Plus", *Modern Materials Handling Machine*, Apr. 1963, pp. 42–46.

*Primary Examiner*—Robert J. Spar
*Assistant Examiner*—D. Glenn Dayoan
*Attorney, Agent, or Firm*—Spensley Horn Jubas & Lubitz

[57] ABSTRACT

A doffed package transporting system in which a memory member on which a mark of a type of a package supported on a package supporting member provided on a package transporting line can be erasably written is securely mounted on the supporting member, and a writing device for writing a mark of a type of a package on said memory member is located at a position at which a package is transferred onto the package supporting member while a reading device for reading the thus written mark of a type of a package is located at a position at which a package is unloaded from the supporting member.

6 Claims, 3 Drawing Sheets

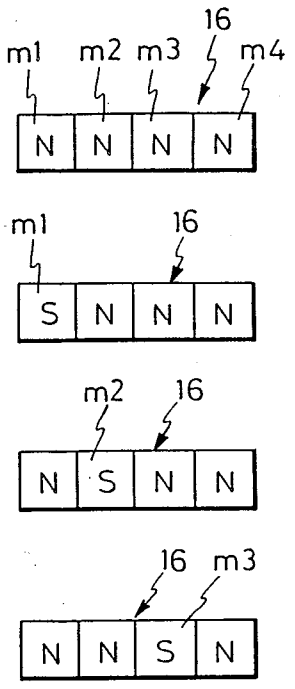
FIG. 4a
FIG. 4b
FIG. 4c
FIG. 4d
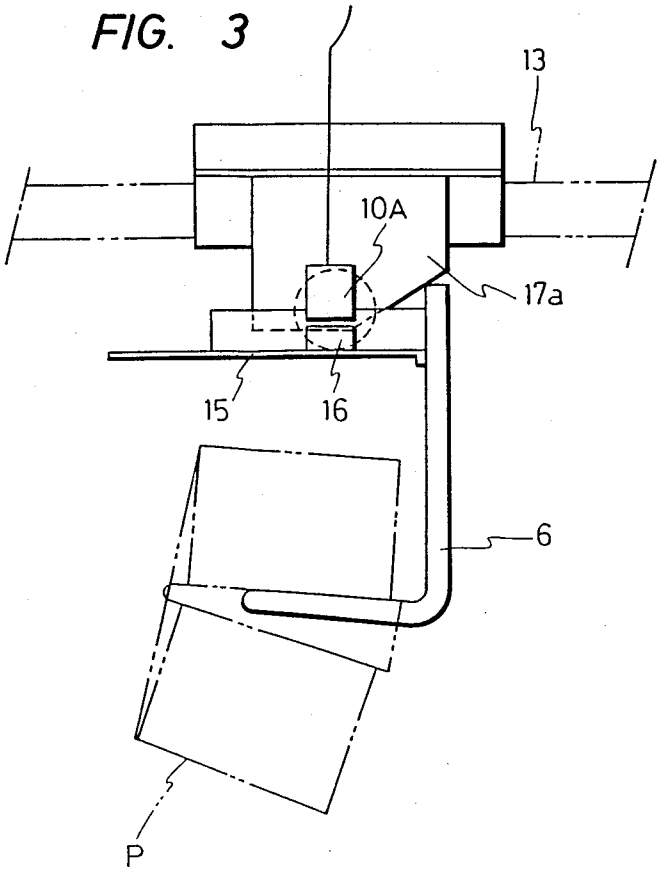
FIG. 3

DOFFED PACKAGE TRANSPORTING SYSTEM

FIELD OF THE INVENTION AND RELATED ART STATEMENT

This invention relates to a system for individually transporting packages doffed from a yarn winding machine such as an automatic winder, and more particularly to a system for transporting a plurality of types of doffed packages.

A system is already known wherein doffed packages are lifted onto an overhead conveyor by a lifting device located adjacent an end of an automatic winder and are transported individually while suspended on hooks of the conveyor.

Means for indicating a type of packages on package suspending hooks provided in a fixed pitch on an overhead conveyor is disclosed in Japanese publication utility model No. 55-51721 wherein the means includes a pin and a switch. In particular, pins for particular types of packages to be suspended on corresponding hooks are securely mounted at predetermined positions adjacent the hooks with such positions being different for each of the package types. Thus, the type of a package suspended on a hook is detected by which one of a plurality of switches provided at a package processing position of a conveyor line is operated by its pin.

[PROBLEMS TO BE RESOLVED BY THE INVENTION]

In such a system as described above, there is no problem when a package suspended on a hook is unloaded at a predetermined position, but there is a problem where a package doffed from a winder is lifted and transferred onto a hook. In particular, since each hook has a pin for a particular package type, even when an empty hook arrives at a package transferring position of a winder which produces packages of, for example, an A type, if the hook is for a different package type than the A type, it is necessary to let the hook pass by without transferring a package onto the hook. Normally, an overhead conveyor has several groups of hooks arranged thereon, for example, such that 10 hooks for an A type are provided successively in a group and further 10 hooks for a B type are provided successively in a group. Accordingly, when a hook arriving at a winder position for the A type is for a different type, a hook for the A type will arrive only after a group of hooks for the different type have passed thereby, resulting in very inefficient package transferring operation. Besides, empty hooks which have passed by the package transferring position and hooks on which packages are suspended will exist at random on the conveyor, making unloading operation at an unloading station troublesome.

OBJECT AND SUMMARY OF THE INVENTION

It is an object of the present invention to provide an efficient transporting system for doffed packages, in which any one of supporting members can be used as a package supporting member for any one of plurality of types of packages.

According to the present invention, a doffed package transporting system is characterized in that a memory member on which a mark of a type of a package supported on each of a plurality of package supporting members provided on a package transporting line can be erasably written is securely mounted on each of the supporting members, that a writing device for writing a mark of a type of a package on the memory member is located at a position at which a package is transferred onto one of the package supporting members while a reading device for reading the thus written mark of a type of a package is located at a position at which a package is unloaded from the supporting member, and that an erasing device for erasing a mark of a type of a memory member on an empty package supporting member is located midway of a portion of the transporting line from the package transferring position to the package unloading position.

BRIEF DESCRIPTION OF THE DRAWING

FIG. 3 a front elevational view of the hook conveyor line and the memory member of FIG. 2; and FIGS. 4*a* to 4*d* are diagrammatic illustrations showing different magnetized conditions of a rubber magnet.

DETAILED DESCRIPTION OF PREFERRED EMBODIMENTS

Figure 1:
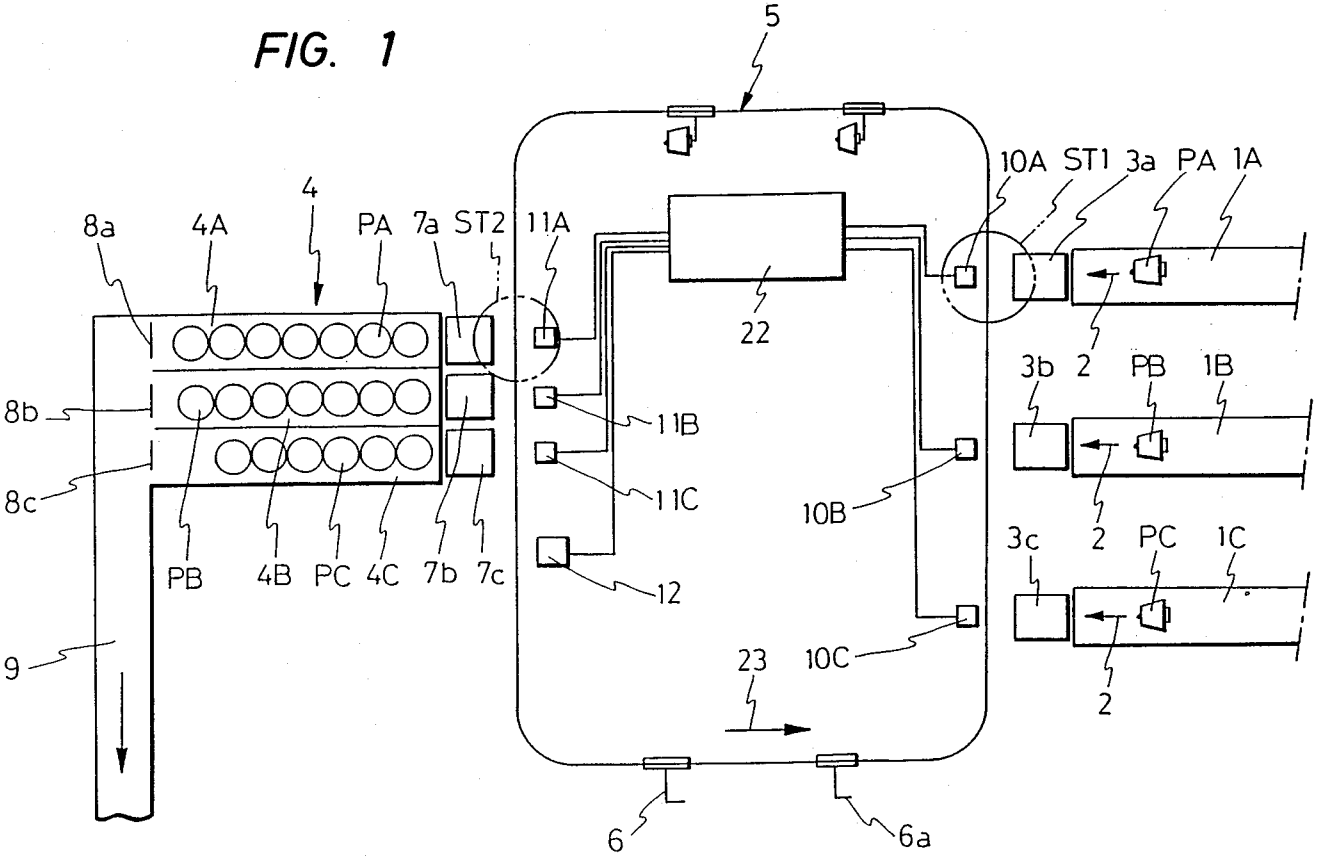
FIG. 1 is a diagrammatic illustration showing an embodiment of a system according to the present invention.

Now, an embodiment of the present invention will be described with reference to the drawing.

FIG. 1 shows an example of a layout of a package transporting system. Reference marks 1A, 1B and 1C denote automatic winders on which different types of packages are produced. Packages PA, PB and PC of the different types doffed from the automatic winders 1A, 1B and 1C, respectively, are transported in directions indicated by arrow marks 2 along the winders to positions of lifting devices 3*a*, 3*b* and 3*c*, respectively.

An overhead conveyor 5 extends in the form of a closed loop between the winders 1A, 1B and 1C and a package storage station 4 The conveyor 5 has a large number of package supporting members, that is, hooks 6 in the present embodiment, supported in a predetermined pitch thereon.

In the package storage station 4, divided lines 4A, 4B and 4C are provided for the individual types of packages, and unloading devices 7*a*, 7*b* and 7*c* for unloading packages from hooks of the overhead conveyor 5 onto the lines 4A, 4B and 4C are located adjacent ends of the lines 4A, 4B and 4C, respectively. As one of movable gates 8*a*, 8*b* and 8*c* is opened in response to a requesting instruction signal from a processing station such as an inspection station or a packaging station, packages PA, PB and PC stored for the individual types on the lines 4A, 4B and 4C are selectively delivered onto a conveyor 9 thus without mixing with packages of different types.

Writing devices 10A, 10B and 10C for writing types of packages to be supported on hooks onto memory members which will be hereinafter described are provided at predetermined positions adjacent the winders 1A, 1B and 1C along the overhead conveyor line 5 while reading devices 11A, 11B and 11C for reading marks written on such memory members are provided adjacent unloading positions. An erasing device 12 for erasing a mark written on a memory member is located midway of a portion of the transporting line 5 from the unloading positions to the package transferring positions adjacent the winders.

Figure 2:
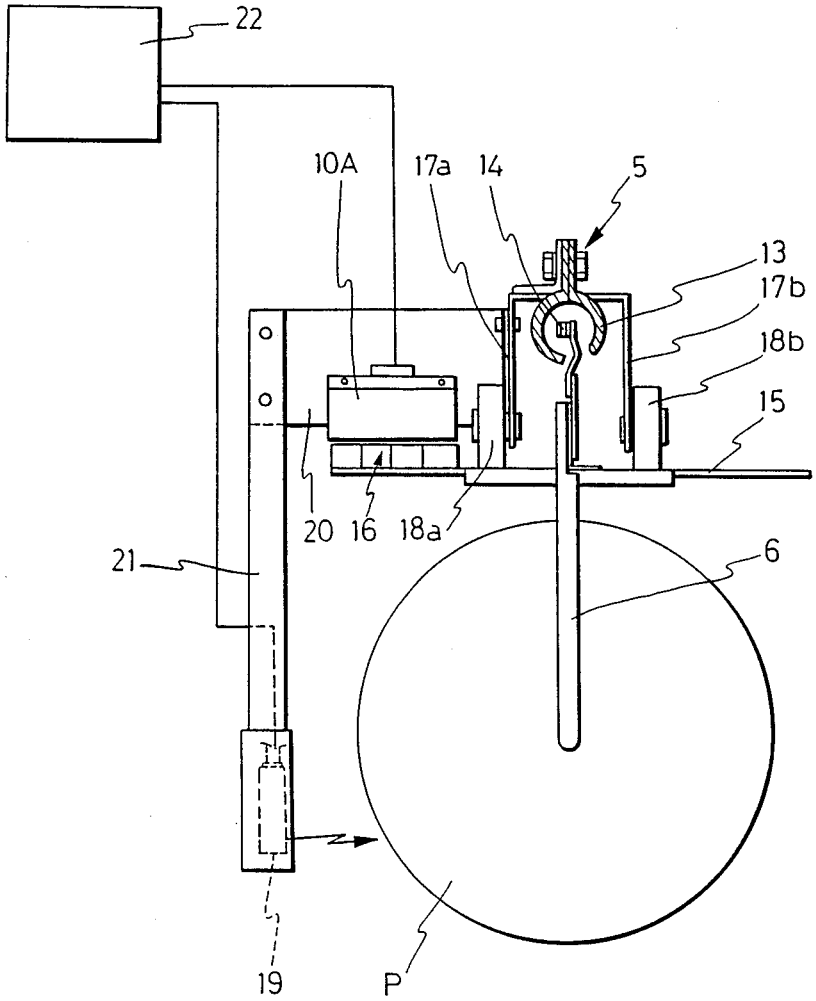
FIG. 2 a side elevational view showing an example of hook conveyor line and a memory member.

A memory member provided on the overhead conveyor line 5 or particularly on its individual hooks 6 is shown in FIGS. 2 and 3.

The transporting path 5 includes a guide rail 13 and a chain 14 which runs in the guide rail 13. A large number of L-shaped package supporting hooks 6 are mounted in a predetermined pitch on the chain 14 for transporting packages P as the chain 14 runs. Reference numeral 15 denotes a guide plate 15 provided in an integral relationship oh each of the hooks 6 for controlling the position of a package at any of the package transferring positions and the unloading positions or at any position of a type memory member 16. In particular, in case FIG. 2 is a front elevational view of a station ST1 of FIG. 1, a pair of guide rollers 18*a* and 18*b* are supported for rotation on a pair of brackets 17*a* and 17*b* secured to the guide rail 13 at any of the transferring positions so that the guide plate 15 is controlled in a horizontal position. The writing device 10A for writing a mark of a type of a package P on a memory member 16 is securely located at a position corresponding to the memory member 16 on the plate 15 integral with the hook 6. Reference numeral 19 denotes a sensor such as a photoelectric tube sensor located on a support plate 21 depending from a fixed bracket 20 for detecting arrival of a package thereat. The writing device 10A, the sensor 19 and like devices receive an instruction from a controller 22 or transmit signals such as an arrival signal to the controller 22.

For example, a rubber magnet which can be freely magnetized and demagnetized may be applied as the memory member 16 on the guide plate 15. As illustrated in FIG. 4*a*, a rubber magnet 16 may have a plurality of sections m1 to m4 which can be individually magnetized to the N or S poles. In case of the rubber magnet 16 of FIG. 4*a*, all of the sections are magnetized to the N poles, and it is assumed here that a type mark is erased with this condition. Thus, in case a package of, for example, the A type is suspended on a hook, only the section ml may be magnetized to the S pole by the writing device, and thus the resulted magnetized condition may be SNNN as seen in FIG. 4*b*. Otherwise, in case of a package of the B or C type, the resulted magnetized condition may be NSNN or NNSN as seen in FIG. 4*c* or 4*d*, respectively.

Accordingly, if an empty hook 6*a* is moving in a direction of an arrow mark 23 in FIG. 1 and an instruction to transport a package doffed from the winder 1A is developed from the controller 22 to the winder 1A, when the hook 6*a* arrives at the transferring position 3*a* corresponding to the winder 1A, the transfer device 3*a* is rendered operative in response to an AND signal between a signal from a hook arrival detector not shown and another signal developed from the package detecting sensor 19 shown in FIG. 2 and representing detection of absence of a package on the hook. As a result, a package PA of the A type is lifted to a position of the hook and a type mark as seen in FIG. 4*b* is magnetized on the rubber magnet 16 by the writing device 10A. Otherwise, if an instruction for transporting a package PC of the winder 1C is developed, directly after arrival of a nearmost empty hook at the transferring position, a package PC of the C type is carried on the hook 6 and the rubber magnet integral with the hook 6 is magnetized as NNSN as seen in FIG. 4*d* by the writing device 10C.

In this manner, hooks supporting different types of packages thereon may be moved on the transporting line 5. Otherwise, when only packages PA doffed from the winder 1A are to be transported preferentially, naturally hooks on which packages of the A type are supported will continue on the line 5.

When a package transported on the line comes to an unloading position ST2, the reading device 11A reads a magnetized condition of the rubber magnet 16 and judges the type of the package on the hook. If the package is of the A type, then the unloading device 7*a* is rendered operative to unload the package on the hook onto the storage conveyor 4A. The hook emptied due to such unloading is then transported to a position adjacent the erasing device 12 located midway of a portion of the transporting line between the storage station 4 and the winders, and the magnetized condition SNNN of the rubber magnet as seen in FIG. 4*b* is erased by the erasing device 12 so that the initial magnetized condition NNNN as seen in FIG. 4*a* is restored in preparation for reception of a new package.

It is to be noted that the erasing device 12 need not be provided at the position as shown in FIG. 1 but may be built in the writing devices 10A to 10C adjacent the winders. In other words, there is no need of provision of a separate erasing device only if a preceding written mark is erased by writing a new mark in place of the preceding written mark.

As apparent from the foregoing description, according to the present invention, memory members on each of which a mark of a type of a package can be erasably written are provided on supporting members which individually transport packages. Accordingly, any one of the support members is not provided for a particular type of packages and can be used as a package supporting member for any one of a plurality of types of packages. As a result, the drawbacks of the conventional systems can be eliminated and very efficient transportation of packages is made possible.

What is claimed is:

1. A system for transporting different types of yarn packages, comprising:

a plurality of automatic yarn winders, each of said automatic yarn winders being operable for producing a corresponding one of said different types of yarn packages randomly with respect to the others of said plurality of automatic yarn winders;

a yarn package storage station having a plurality of yarn package receiving lines, each of said receiving lines being operable to receive a corresponding one of said different types of yarn packages;

a conveying means disposed adjacent said automatic winders and said yarn package storage station operable for conveying yarn packages, as the yarn packages are randomly produced by said automatic winders, to said package storage station;

memory means, associated with each yarn package conveyed by said conveying means, for recording the type of yarn package associated therewith;

writing means for writing indicia on said memory means, said indicia indicating the type of yarn package associated with said memory means;

reading means for reading the indicia and for determining the type of each yarn package conveyed by said conveying means to said package storage station;

unloading means, responsive to the type of yarn package determined by said reading means, for unloading each of said types of packages from said conveying means onto a separate one of said receiving lines;

an erasing device for erasing a mark written on said memory means, said relasing device being located between said winders and said package storage station and adjacent the conveying means;

a plurality of package supporting members, each package supporting member having an L-shaped package supporting hook and a guide plate provided in an integral relationship with the hook, wherein said memory means in disposed on the guide plate;

wherein said conveying means comprises a guide rail for supporting a plurality of said L-shaped package supporting hooks; and wherein said system further comprising a pair of rotatable guide roller supported by said guide rail for controlling the horizontal position of said guide plate of the package supporting members, whereby the memory means may be positioned to correspond with the writing device.

2. A system as claimed in claim 1, wherein said memory means comprises a rubber magnet which can be fully magnetized and demagnetized, said rubber magnet having a plurality of sections which can be individually magnetized.

3. A system as claimed in claim 1, further comprising a sensor for detecting arrival of a package said sensor being located adjacent said winders.

4. A system as claimed in claim 3, further comprising a controller for transmitting and receiving signals to and from said writing means, said reading means, said sensor for detecting arrival of a package and said erasing device.

5. A yarn winding apparatus, comprising:

a first yarn winding machine operable for producing a first type of yarn package;

a second yarn winding machine operable for producing a second type of yarn package;

a yarn package storage station having a first yarn pack age receiving line for receiving said first type of yarn package and a second yarn package receiving line for receiving said second type of yarn package;

a conveyor having a plurality of yarn package receptacles, each of said receptacles being operable for receiving one of said first type of yarn package and each of said receptacles being operable for receiving one of said second type of yarn package, said conveyor being operable for conveying said first type of yarn package and said second type of yarn package from said winding machines to said yarn package storage station;

determining means for determining the type of yarn package conveyed by said conveyor from said winding machines to said yarn package storage station; and unloading means, responsive to said determining means, for unloading said first type of yarn package onto said first receiving line and for unloading said second type of yarn package onto said second receiving line.

6. A yarn winding apparatus as claimed in claim 5, further comprising:

a plurality of substantially horizontal guide plates, each of said substantially horizontal guide plates being associated with a corresponding one of said yarn package receptacles;

a corresponding plurality of memory means, each of said memory means having a position which is associated with a corresponding one of said substantially horizontal guide plates, and each of said memory means being operable for recording the type of yarn package received by said yarn package receptacle associated with said substantially horizontal guide plates; and a plurality of guide rollers for controlling the substantially horizontal position of said substantially horizontal guide plates;

whereby the position of said plurality of memory means associated with said plurality of substantially horizontal plates is controlled.

* * * * *